US005787665A

United States Patent [19]

Carlin et al.

[11] Patent Number: 5,787,665

[45] Date of Patent: Aug. 4, 1998

[54] COMPOSITE WALL PANEL

[76] Inventors: Steven W. Carlin; Robert M. Dresslar, both of 4073 39th St., Newport Beach, Calif. 92663

[21] Appl. No.: 683,670

[22] Filed: Jul. 17, 1996

Related U.S. Application Data

[60] Provisional application No. 60/018,050 May 21, 1996.

[51] Int. Cl.[6] ..... E04C 1/00

[52] U.S. Cl. ..... 52/309.4; 52/309.6; 52/309.11; 52/483.1; 52/586.1; 52/783.1

[58] Field of Search ..... 52/309.4, 309.6, 52/309.11, 506.03, 481.1, 481.2, 478, 586.1, 783.1, 783.13, 459, 468, 541, 731.2, 731.1, 779, 309.3, 309.7, 309.9, 309.15, 458, 591.4, 800.1, 242, 716.1

[56] References Cited

U.S. PATENT DOCUMENTS

| | | | |
|---|---|---|---|
| 726,506 | 4/1903 | Copen | 52/591.4 |
| 1,156,753 | 10/1915 | Corey | 52/591.4 X |
| 2,796,158 | 6/1957 | Miles et al. | 52/716.1 X |
| 3,411,252 | 11/1968 | Poyle, Jr. | 52/468 X |
| 3,553,415 | 1/1971 | Possovoy | 52/468 X |
| 3,964,221 | 6/1976 | Berqvist | 52/591.4 X |
| 4,138,808 | 2/1979 | Wolkiewicz, Jr. | 52/459 |
| 4,223,500 | 9/1980 | Clark et al. | 52/309.4 |
| 4,953,334 | 9/1990 | Dickens | 52/309.4 |
| 5,218,803 | 6/1993 | Wright | 52/481.1 X |
| 5,279,089 | 1/1994 | Gulur | 52/309.11 |

FOREIGN PATENT DOCUMENTS

| | | | |
|---|---|---|---|
| 1609819 | 6/1970 | Germany | 52/800.1 |

*Primary Examiner*—Carl D. Friedman
*Assistant Examiner*—W. Glenn Edwardi
*Attorney, Agent, or Firm*—William G. Lane

[57] ABSTRACT

A structural, insulating, insect resistant, dimensionally stable composite wall panel for building construction comprising a regular tetragonal body of polymer foam having two opposing primary wall surfaces bounded on its sides by two parallel side walls and on its ends by two parallel end walls; and at least one light metal gauge hollow stud in the body, each light metal gauge stud extending at least from one end wall to the other end wall and parallel to the side walls of said body, the polymer foam extending into the center of the stud to secure the stud to the body, at least one side wall of each stud forming a portion of the same primary wall surface of said body.

1 Claim, 16 Drawing Sheets

COMPOSITE WALL PANEL

Applicants claim the benefit of prior filed copending provisional patent application Ser. No. 60/018,050 on COMPOSITE WALL PANEL filed on May 21, 1996.

FIELD OF THE INVENTION

The present invention is directed to polymer/metal composite wall panels. In particular, lightweight, thermal and sound insulating, polymer/metal composite wall panels. The panels, optionally, and preferably, also constitute structural supporting members.

BACKGROUND OF THE INVENTION

Composite building panels are known to the art. Dickens U.S. Pat. No. 4,953,334 discloses a building panel having an expanded cellular core with side edge reinforcing strips. The panels fit in a complementary manner with stepped core edges of different step widths to form rectangular troughs along the edges of mating panels for utility lines. Panels are used for renovation of existing building structures wherein the panels are applied on the existing building walls.

Gulur U.S. Pat. No. 5,279,089 discloses an insulated wall system comprising tubular support members secured to footings and headers. The space between the tubular support members are filled with extruded polymer foam sheets in a three ply sandwich construction.

The panel of U.S. Pat. No. 4,953,334 is made for applying to an existing wall structure and is not a structural supporting member. The reinforcement strips are a custom design and cannot be purchased off the shelf.

U.S. Pat. No. 5,279,089 discloses a wall system which is built from scratch on site in the same manner that wood frame walls are constructed. Structural supporting panels are not used in U.S. Pat. No. 5,279,089 patent and the tubular framing must be accurately centered and secured to the headers and footers in order that the insulated polymeric foam panels can be inserted into the space between adjacent tubular support members with a minimum of cutting and "fitting".

The U.S. Pat. No. 5,279,089 patent discloses that a division of the Atlantic Richfield Company markets a wall system of expanded polystyrene and metal frame members under the trademark WALLFRAME and that NU-TECH Building Systems of Cleveland, Ohio markets a wall system of the same type under the trademark CANOTHERMO.

SUMMARY OF THE INVENTION

One embodiment of the present invention is directed to a structural, insulating, insect resistant, dimensionally stable composite wall panel for building construction comprising a regular tetragonal body of polymer foam having two opposing primary wall surfaces bounded on its sides by two parallel side walls and on its ends by two parallel end walls; and at least one light metal gauge stud in the body, the stud having a hollow center cavity, a squared cross section with a wide back wall extending the width of the stud, two parallel side walls, two narrow front walls parallel to the back wall and separated by an open slot extending into the central cavity, each light metal gauge stud extending at least from one end wall to the other end wall of said body and parallel to the side walls of said body, the polymer foam extending into the central cavity of the stud to secure the stud to the body, and at least one side wall of each stud forming a portion of the same primary wall surface of said body.

The opposing primary wall surfaces are the major wall surfaces that will constitute room walls, exterior walls and the like. The studs employed in the present invention are the light metal gauge studs which are employed throughout the country which have a squared or regular tetragonal cross section.

For composite wall panels employed in the interior of a building, the width of the panel between the two primary wall surfaces will normally be equal to the width of the studs and the side wall of the studs will form a portion of both the primary wall surfaces. In other words, the side walls of the studs will be visible as a portion of the primary wall surfaces of the panel.

The ends of the composite wall panels are adapted to be received by and secured in the open channel of light metal gauge building construction tracks to form a structural wall. The panels are secured to the tracks by self-threaded fasteners which extend through the wall of the track into the side wall of the studs. The bottom track is attached to the floor system of the building and the top track will support the ceiling, upper flooring and roofing members of the building.

In a preferred embodiment of the present invention, a stud will be one of the side walls of the body. Even more preferably, the back wall of a stud will be one of the side walls of the body.

In the preferred embodiment of the present invention, the panels width will be equal to a standard center to center distance of studs for standard building construction or an integral multiple thereof. For example, 16 inches is a standard building construction stud center to center distance. The panels can be 60 inches wide, 32 inches wide, or 48 inches wide and the like. For some construction, the center to center distance is 12 inches and for other applications, the center to center distance can be 24 inches. For exterior construction, the panel will preferably have at least two light metal gauge studs which are distanced apart from each other center to center a standard building construction center to center distance for studs, such as 12 inches, 16 inches or 24 inches or a multiple thereof.

When the composite wall panel is wider than the stud width, and a stud is positioned on the side wall of said body, the stud will only form a part of the side wall since is it not wide enough to cover the entire width of the side wall. For composite wall panels that are wider than the studs, the panel will have a tongue portion at each of its ends. The tongue portion will have a width equal to the width of the studs and the tongues will be adapted to be received by and secured in the open channel of light metal gauge building construction track to form a structural wall.

A preferred composite panel of the present invention comprises a structural, insulating, insect resistant, dimensionally stable composite wall panel for building construction comprising a regular tetragonal body of polymer foam having two opposing wall surfaces bounded on its sides by two parallel side walls and on its ends by two parallel end walls; and one light metal gauge stud in the body, the stud having a hollow center cavity, squared cross section with a wide back wall extending the width of the stud, two parallel side walls, two narrow front walls separated by an open slot extending into the central cavity, light metal gauge extending at least from one end wall to the other end wall of said body and parallel to the side walls of said body, the polymer foam extending into the central cavity of the stud to secure the stud to the body, the width of the panel between the two primary wall surfaces equal to the width of the stud and the side walls of the stud forming a portion of the primary wall surfaces; the back wall of the stud is one of the side walls of said body, and the ends of said body adapted to be received by and secured in the open channel of light metal gauge building construction track to form a structural wall.

A further preferred embodiment of the present invention comprises a structural, insulating, insect resistant, dimensionally stable composite wall panel for building construction comprising a regular tetragonal body of polymer foam having two opposing primary wall surfaces bounded on its sides by two parallel side walls and on its ends by two parallel end walls; and at least two light metal gauge studs in the body, each stud having a hollow center cavity, a squared cross section with a wide back wall extending the width of the stud, two parallel side walls, two narrow front walls separated by a open slot extending into the central cavity, each light metal gauge stud extending at least from one end wall to the other end wall of said body and parallel to the side walls of said body. The polymer foam extending into the central cavity of the studs to secure the studs to the body, the width of the panel between the primary wall surfaces being greater than the width of the studs, at least one side wall of each stud forming a portion of the same primary wall surface of said body, the back wall of one stud being a part of one of the side walls of said body, said body having a tongue portion at each of its ends, the tongue portion having a width equal to the width of the studs, the tongue portion adapted to be received by and secured in the open channel of light metal gauge building construction track to form a structural wall.

The preferred wall panel system of the present invention a structural wall for building construction based on a light metal gauge stud, a channel and track construction, comprising a light metal gauge track with an open channel secured for building floor system and a second light metal gauge track with an open channel for receiving, securing and supporting a ceiling and roofing structural members, the tracks separated by, supported by and secured to each other with two or more structural, insulating, insect resistant, dimensionally stable composite wall panels for building construction, each panel comprising a regular tetragonal body of polymer foam having two opposing primary wall surfaces bounded on its sides by two parallel side walls and on its ends by two parallel end walls; at least two light metal gauge studs in the body, each stud having a hollow center cavity, a squared cross section with a wide back wall extending the width of the stud, two parallel side walls, two narrow front walls parallel to the back wall and separated by an open slot extending into the central cavity, each light metal gauge stud extending at least from one end wall to the other end wall of said body and parallel to the side walls of said body, and polymer foam extending into the central cavity of the stud to secure the stud to the body, at least one side wall of each stud forming a portion of the same primary wall surface of said body, the distance between the studs, from center to center of the studs, is a standard building construction center to center distance for studs, studs of the panels being secured to the first and second tracks by self-threaded screws extending through the side walls of the tracks into the side walls of the studs.

The present invention is directed to a lightweight, thermal and sound insulating, polymer/metal composite wall panel. The wall panel is preferably a structural supporting member for the construction of a building. The panels can be utilized on the exterior walls and in the interior walls of the building. The invention is also directed to a wall system comprised of a plurality of assembled lightweight, thermal and sound insulating, polymer/metal composite wall panels as described herein.

The lightweight, thermal and sound insulating polymer/metal composite wall panels (hereinafter referred to as "composite wall panels") comprise a continuous panel of extruded or expanded closed cell, polymer foam having flat parallel exterior surface and interior surface, parallel longitudinal sides, parallel end sides and at least one light metal gauge stud embedded in the polymer foam panel with one side of each stud exposed on the interior side of the wall panel and extending the full longitudinal length of the wall panel. The wall panel is adapted to be received and fastened in a light gauge metal bottom track and top track for the construction of exterior and interior walls of a building.

The light gauge metal studs are positioned in the wall panel at equal distances so that when wall panels are assembled together they to form a wall system of two or more wall panels with the metal studs positioned equal distance from each other on centers, such as 12 inches, 16 inches, 24 inches and 48 inches centers.

In another embodiment of the present invention, the metal studs are rectangular in cross section having an open slot running the length of the stud. The studs optionally have one or more holes in their back wall. The central cavity of each stud is filled with the polymeric foam of the wall panel. One of the studs is preferably positioned to form part of one of the longitudinal side of the wall panel. In one embodiment of the present invention, the stud is positioned so that its open slot is exposed on the longitudinal side of the composite wall panel. In this embodiment, some of the polymeric material is removed from the open slot of the stud to form a groove. The other longitudinal side of the composite wall panel is formed with a tongue so that when the composite wall panels assembled together, the tongue of one wall panel will engage the groove of the adjacent wall panel to form a continuous wall system having planar, non-stepped, exterior surfaces and interior surfaces.

In another embodiment of the present invention, the light gauge metal studs are positioned inwardly from the longitudinal sides of the composite wall panel so that only one side of each stud is exposed on the interior surface of the composite wall panel. In a further embodiment of the present invention, such wall panel is fabricated with a groove in the panel body along one longitudinal side and a tongue in the panel body along the opposing longitudinal side so that when adjacent composite wall panels are assembled together to form a wall system, the tongue and groove come together and mate to increase the strength of the resulting wall system panel and to minimize draft through the joint of the adjacent panels and the loss of insulating value for the resulting wall system.

In another embodiment of the present invention, an interior composite wall panel having a single light metal gauge stud with a wall panel body of polymer foam. The wall panel has two opposing flat surfaces forming interior room walls, two parallel and opposing longitudinal sides and two parallel end sides, that is, a top and bottom. The stud can be placed along the edge of a composite wall panel, that is, it can constitute one of the longitudinal sides or the stud can be positioned within the middle of the composite wall panel so that polymer foam forms the longitudinal sides. The stud extends the full length of the wall panel and the depth of the wall panel from building wall surfaces is the same distance as the greatest dimension of the light metal gauge stud. The interior composite wall panel can also be formed with tongue and grooves as described above.

The composite wall panels of the present invention are prepared in a mold employing conventional light gauge metal studs which can be purchased off the shelf.

Utilities can be run up from the floor or down from the ceiling of a building down through the composite wall panels or they can be passed horizontally through the wall panels optionally through holes and apertures in the metal studs. The positions of the holes and apertures in the metal studs can be marked on the exterior major surfaces of the wall panels. However, longitudinal runs of utilities such as wiring and piping through the studs may require that the foam material be worked out of the central cavity and holes or apertures of the stud and, for that reason, it is easier, quicker, and more economical to run the utilities from the top or from the bottom of the panel. Runs or channels for the utilities can be cut into the polymer foam of the panel body using heat guns which are readily available on the market. Holes, cut or pre-punched, in the light gauge metal top, or bottom track permit the utilities to be run through the tracks into the panel. The runs or channels can be cut in the panel to intercept such holes. Once the utility is placed in the run or channel, the channel can be back filled with foam from a foam gun or it can be left open because the surface of the composite wall panel is normally dressed. The interior surface can be dressed with gypsum board or lathe and plaster construction or with composite panels and the exterior surface is dressed with Tyvek or an equivalent membrane or tar paper, and then stucco, paneling, shingles, brick, masonry, composite paneling, elastomeric coating or the like. Some back filling of the utility run or channel with polymer foam is desired to prevent freedom of movement of the utility in the channel which can create noise, to provide fire blocks and to provide blocks to air drafts.

The studs must be exposed on one surface of the wall panel in order to thoroughly fasten gypsum board or other wall covering to the surface of the composite wall panel and to permit the installation of earthquake straps which are required in earthquake prone geological areas and high wind areas. The composite wall panel cannot be properly strapped with earthquake straps if the studs are fully encapsulated by the polymer foam more than a ¼ inch thick.

A wall system utilizing the composite wall panels is made by securing a u-shaped open light gauge metal track to the exterior perimeter of a floor, or the exterior perimeter of a building slab, or a floor system. The panels are dropped into the track positioned side by side and the metal studs of each panel are fastened to the side walls of the track using self tapping metal screws. The position of the studs covered by polymer foam is indicated by a stud marker on the exterior surface side of the wall panel.

DETAILED DESCRIPTION OF THE INVENTION

Figure 1:
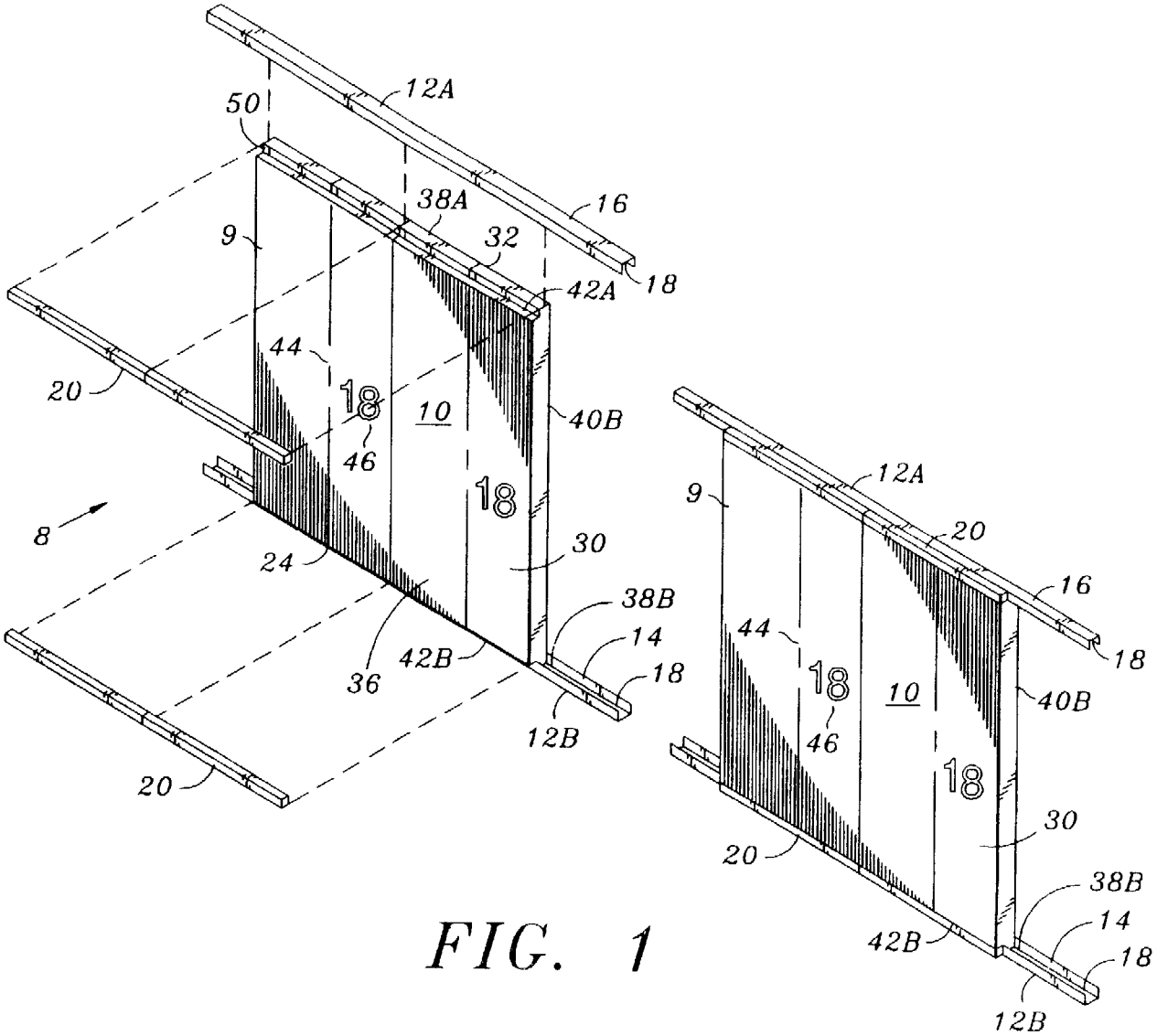
FIG. 1 is a prospective view of the wall system of the present invention employing the composite wall panels of the present invention.
Figure 2:
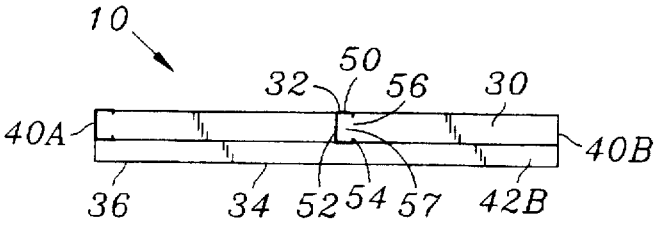
FIG. 2 is a bottom view of the composite wall panel shown in FIG. 1.
Figure 3A:
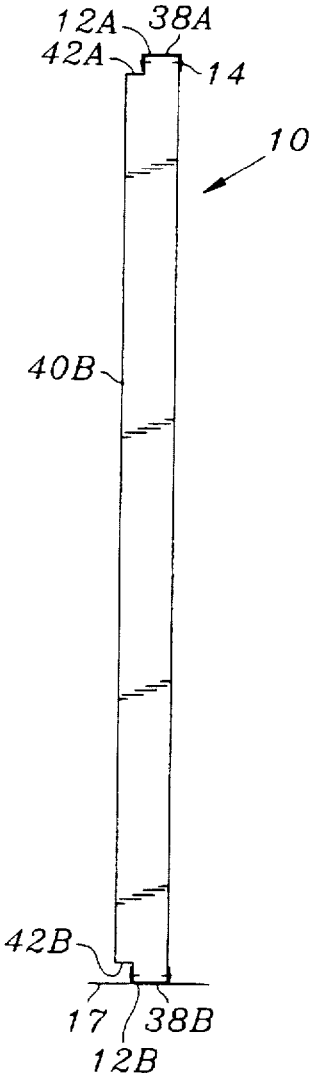
FIG. 3A is a plan end view of a longitudinal side of the composite wall panel of FIG. 1.
Figure 4:
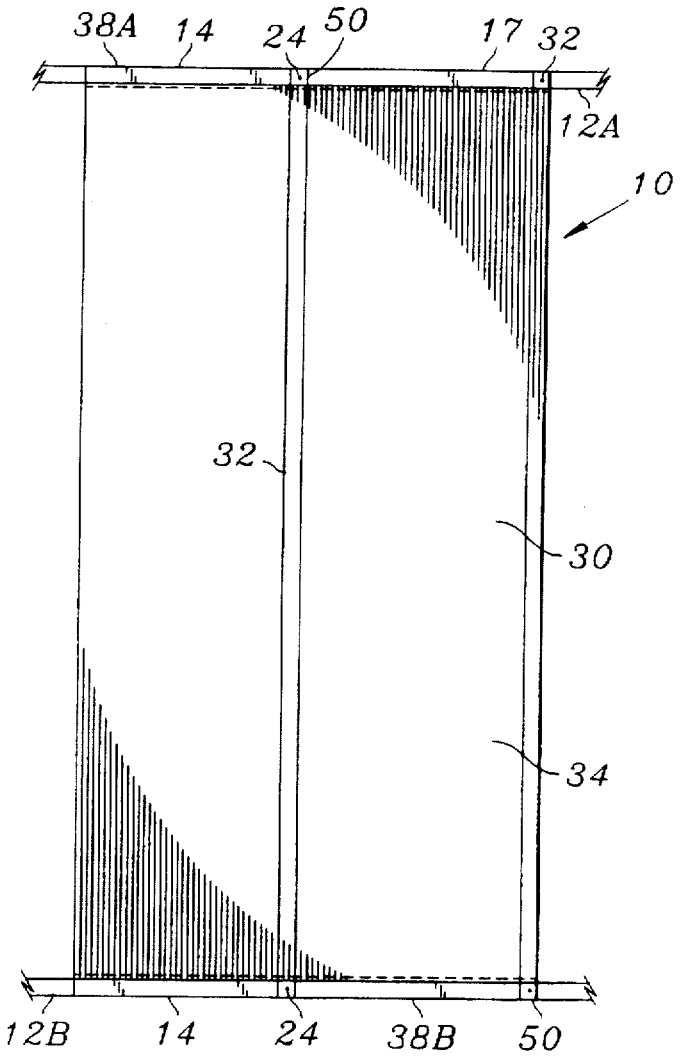
FIG. 4 is a plan view of a primary wall surface of the composite wall panel of FIG. 1.
Figure 3B:
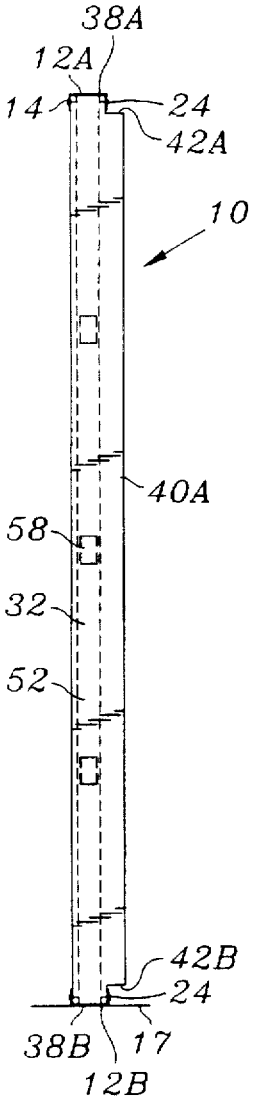
FIG. 3B is a plan view of the other longitudinal side of the composite wall panel of FIG. 1.

Referring to FIG. 1, the wall system of the present invention comprises a top track or plate 12A, a bottom track or plate 12B, composite wall panels 10 and horizontal filler pieces 20. The tongue of the bottom end 38B of the composite wall panels 10 are dropped into the open channel 18 of the bottom track 12B. The panels are aligned together to form a continuous wall system 9 having planar exterior and interior surfaces. The composite wall panels are secured to the bottom track by self tapping metal screws 24 which extend through the side walls 14 of the track into the side walls 50 of the studs 32. After the composite wall panels have been assembled together and secured to the bottom track, the top track 12A is dropped onto the tongues at the top end 38A of the panels. The top track is secured to the wall panels by screwing the side walls 14 into studs 32 with self tapping metal screws 24.

Doors (not shown) for wall structures are made in the usual way with lightweight gauge metal studs and tracks. The transverse width, that is the width from one longitudinal side 40A of the panel 10 to the other longitudinal side 40B (side to side width), can be cut to size with a heat gun down to a size to fit where a door is to be situated. Similarly, windows (not shown) can be constructed in the usual manner that they are constructed with light metal gauge studs and track and, optionally, the panel can be cut with a heat gun to accommodate smaller windows within the space between two studs.

For light gauge metal studs, the "on centers" for the studs is normally 24 inches compared to 16 inches for wood studs. A building fabricated from light metal gauge studs and tracks are far stronger than a building constructed from wooden "2×4" frame construction. The gauge of the metal used in the light gauge metal studs can be varied for a particular application. Gauges range from 12 to 25, although other gauges are available. It is difficult to determine the gauge of a light gauge metal stud when the panels are formed. Accordingly a marker 46 is placed on the interior or exterior surface, optionally on both surfaces, to identify the metal gauge. Such a marker is shown in FIG. 1 as element 46. The position of the studs on the exterior surface 36 is indicated by marker 44 which can be a score line, dimples, small depressions, diamond marks, paint marks or the like. This permits the carpenters and installers to determine the position of stud in the panel for purposes of fastening the tracks to the panels and attaching elements, such as wall board, to the studs. Since one of the studs in the composite wall panel 10 is situated at one of the longitudinal sides of the wall panel, the marker 44 can be omitted for the end stud because carpenters and installers know that studs are centered ¾ inches in from the longitudinal side of a wall panel. However, wall panels can optionally have a marker also showing the end stud. After the wall panels have been assembled and fastened to the bottom track and top track with fasteners 24 as described above, the space partially formed by shoulders 42A and 42B is filled with horizontal filler pieces 20. This provides that the surface 36 of the wall system 9 is flat, smooth and continuous from the top to bottom and side to side of the joined panels.

Referring to FIGS. 2–5, the composite wall panel 10 has a single piece, continuous polymer foam body 30 and two light gauge metal studs 32 partially embedded in the polymer foam body. The studs at least extend from one end 38A to the other end 38B of the panel. The studs and length of the body 30 can be the same. Shrinkage of the polymer foam during the manufacture of the panels may render the body 30 slightly shorter and narrower than the studs 32. This slight size difference is not detrimental to the panel, its use or the wall system fabricated from the panel. The panels are manufactured in a mold by injection, extrusion, or the like of the polymer or polymer foam. The polymer foam flows into the central cavity of the stud through holes 58 in the back wall 52 and/or through open slot 56 of the studs 32. It is easier to fill the central cavity 57 with polymer foam through the open slot than the holes 58 during the manufacturing process. Thus in the preferred embodiment, the open slots of the studs face to the interior of the polymer foam body 30 as shown in panel 10 of FIGS. 1–5 to insure filling the central cavity of the stud with polymer foam. The filling of the central cavity with polymer foam strengthens the stud and prevents deflections of the stud side walls 52 during the fastening of the panel studs to the tracks with threaded fasteners or the like.

The panel can have more than two studs, for example, it can have three studs on equal centers, such as 16 inch centers for a 48 inch wide panel. The body is a continuous piece of polymer foam and the foam extends into the central cavity 57 of the studs through open slot 56 and, in some embodiments, through holes 58 in the stud to securely fasten the stud and body together. Optionally the stud sides can be treated with an adhesive or primer to aid in cementing the polymer foam to the walls of the stud.

Figure 5:
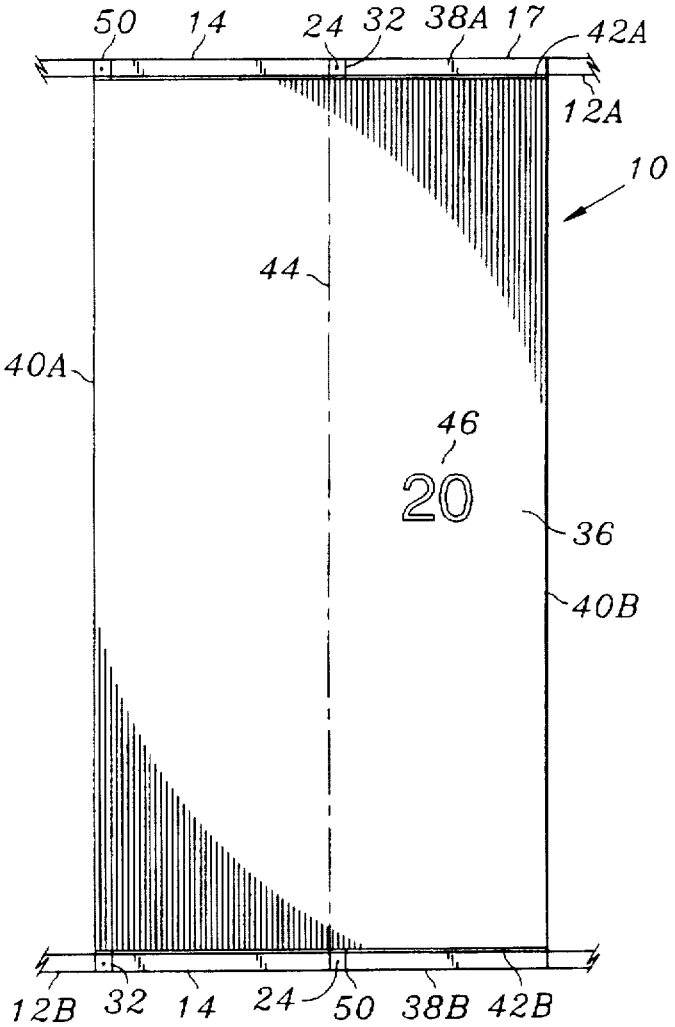
FIG. 5 is a plan view of the opposing primary wall surface of the composite wall panel of FIG. 1.

The studs have two narrow side walls 50, a back wall 52 running the width of the stud and two small front walls 54 parallel to the back wall and separated by slot 56 which is in communication with the central cavity 57. One of the narrow walls 50 of the studs 32 is exposed on the surface 34 of the panel. The body 30 of the panel shields the other walls of the studs to prevent corrosion from water and chemicals. In this embodiment, one stud, situated on one of the longitudinal sides of 40A of the panel, has one side wall 50 and its back wall 52 also exposed to the exterior. The light gauge metal studs are normally galvanized coated steel optionally painted with a corrosive resistant paint. The back wall of the studs normally have one or more openings 58 which can be used for running utility lines and the like through the panel (see FIG. 3B). The top of each panel has a shoulder 42A and the bottom of each panel has a shoulder 42B. These shoulders provide large tongues at the top 38A and at the bottom 38B of the panel. The tongues are the width of the studs and fit into the open channels 18 of the top and bottom tracks as described above. One side of each stud is exposed on the interior surface 34 of the panel. It is easier to assemble panels with the studs exposed on one primary wall surface, such as primary wall surface 34. However, since the stud is only expose on the one wall surface, the polymer foam of the body 30 protects the other sides of the studs from corrosion as discussed above. A side wall 50 of each studs is exposed. If the studs are positioned on the sides 40A and 40B with the back walls 50 facing out, these walls are also exposed. As shown in FIG. 5, the exterior surface bears stud markers 44 to indicate the center of the narrow wall 50 of each stud so that the installer will know where to attach paneling, lathe board, etc. to the studs of the wall panel with threaded fasteners (not shown). The exterior surface can also bear at least one legend 46 indicating the gauge of the light gauge metal stud. Optionally, the legend can appear on the interior surface of the wall panel or on both surfaces. The legend can be embossed, painted or inked on the surface of the panel polymer foam.

The body 30 of the panel is one continuous piece of polymer foam. The foam as well as the light metal gauge studs are dimensionally stable and are not effected by humidity, dampness or moderate temperature changes. Preferably the polymer foam is preferably closed cell which is waterproof. Thus the panels can be used in desert, tropical, sub-tropical, arctic and temperate environments and climates.

The panels can be designed for different seismeric zones, wind loads, live loads, dead loads and axial loads prescribed by building codes and/or structural engineers. The polymer foam, especially expanded polystyrene, has good compressive strength and provides substantial shear resistance and inhibits twisting of the studs.

Figure 6:
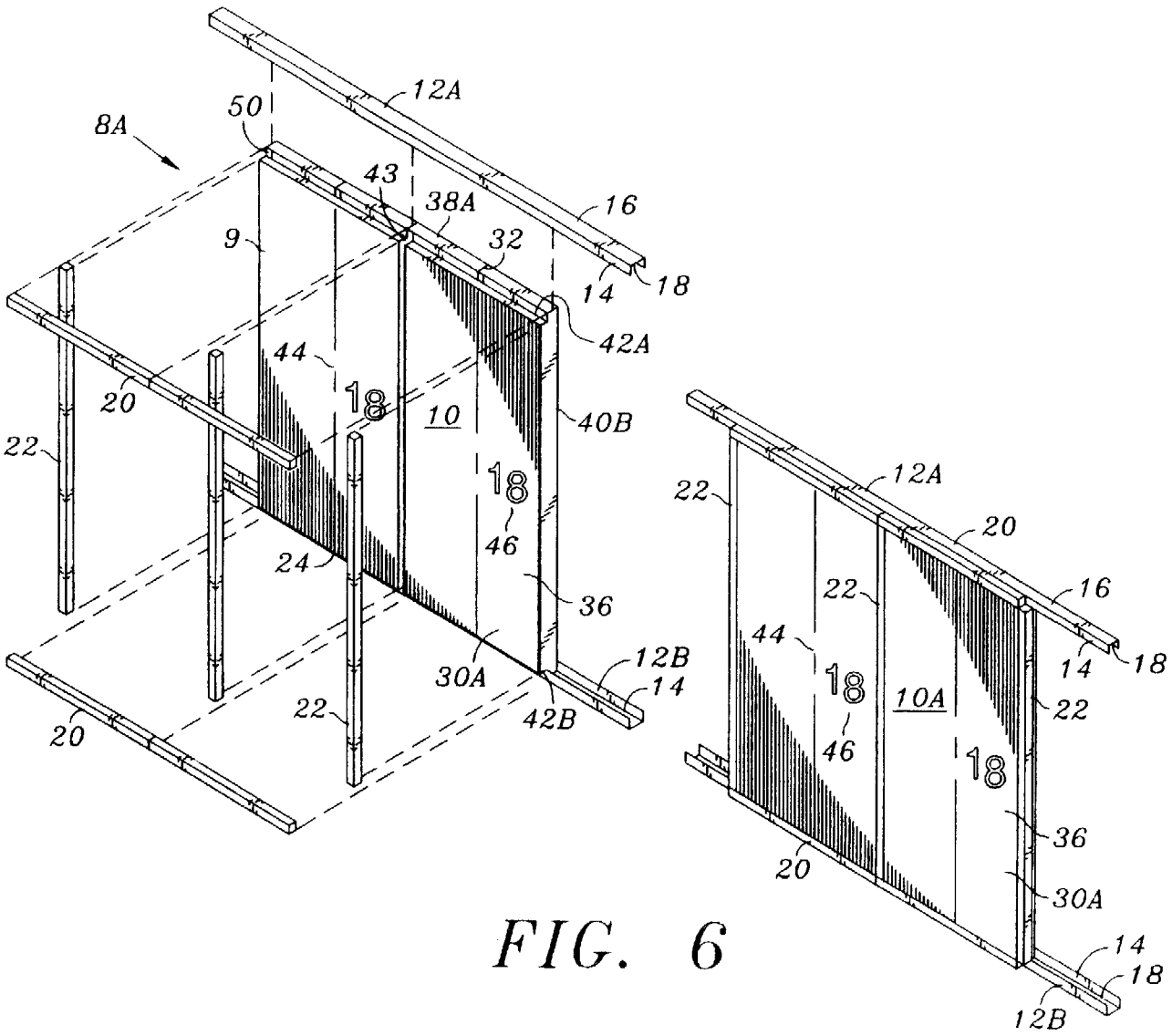
FIG. 6 is a prospective view of another embodiment of the wall system of the present invention employing another embodiment of the composite wall panel of the present invention.
Figure 7:
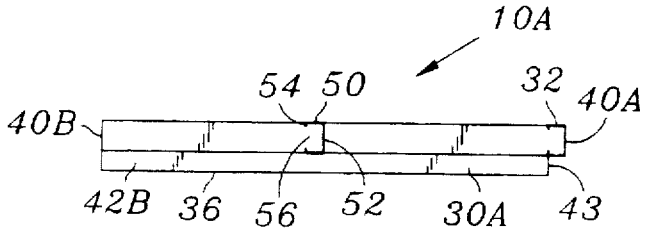
FIG. 7 is a bottom plan view of the composite wall panel of FIG. 6.
Figure 8A:
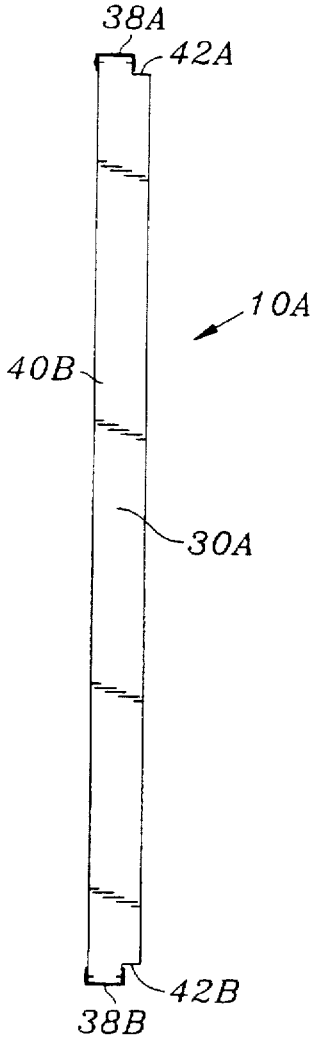
FIG. 8A is a plan view of a longitudinal side of the composite wall panel of FIG. 6.
Figure 9:
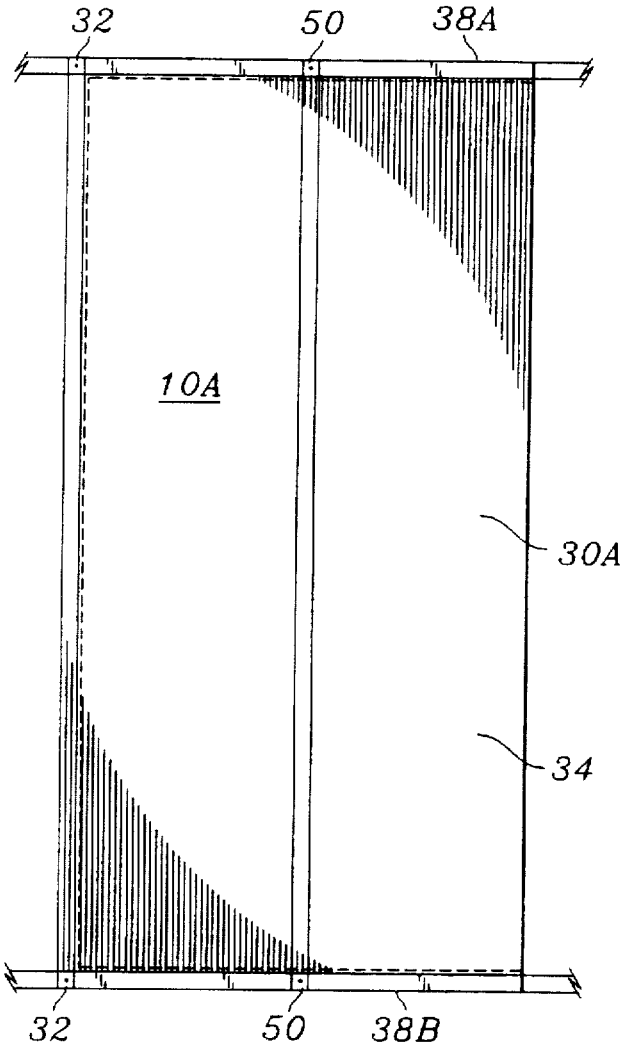
FIG. 9 is a plan view of a primary wall surface of the composite wall panel of FIG. 6.
Figure 8B:
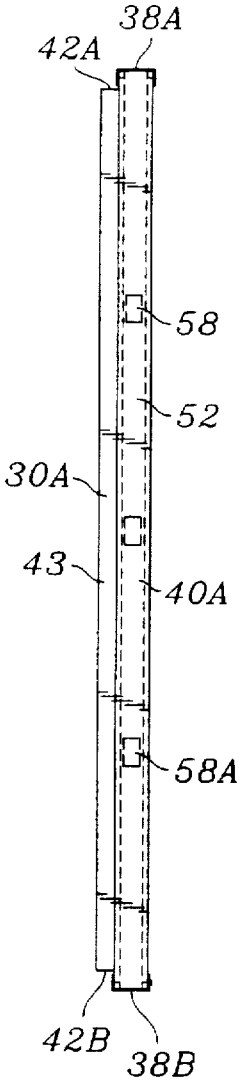
FIG. 8B is a plan view of the other longitudinal side of the composite wall panel of FIG. 6.
Figure 10:
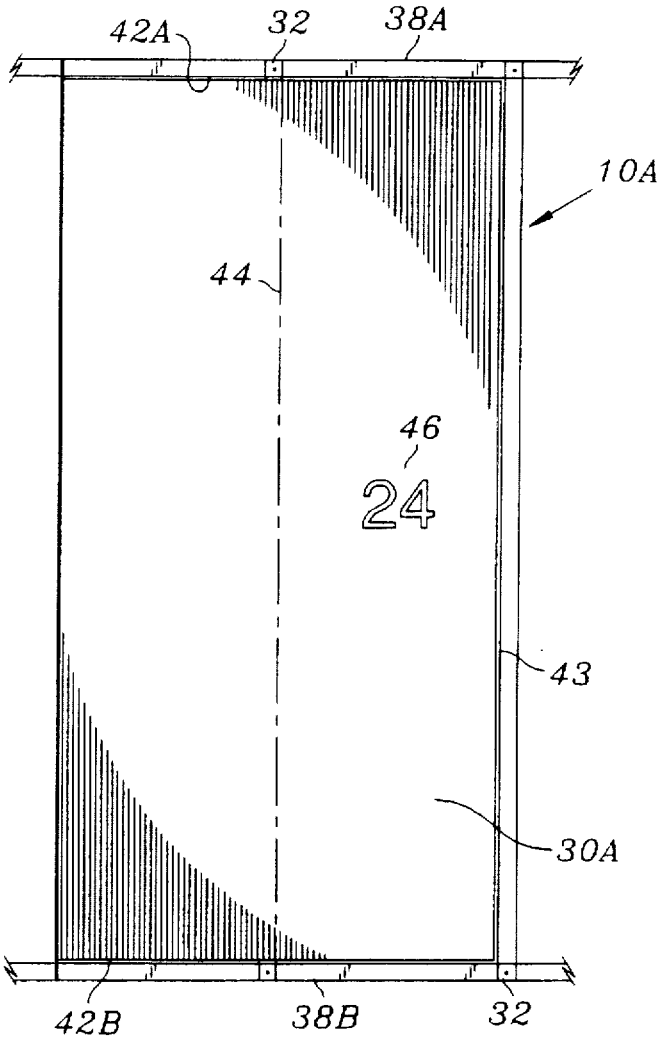
FIG. 10 is a plan view of the exterior primary wall surface side of the composite wall panel of FIG. 6.

FIG. 6 shows another embodiment of the wall system of the present invention. Common elements between the wall system 9A of FIG. 6 and wall system 9 of FIG. 1 bear the same number and the same description as set forth above. The wall system of 9A of FIG. 6 employs another embodiment of the composite wall panel 10A of the present invention. This wall panel has a longitudinal shoulder 43 running the length of the panel along one of the longitudinal sides 40 of the panel. When the panels 10A are assembled together, a slot 26 is created which is filled with vertical filler piece 22 as shown in FIG. 6. In all other respects, the wall system of FIG. 6 is similar to the wall system of FIG. 1.

Referring to FIGS. 7–10, the composite wall panel 10A has a shoulder 43 when two panels 10A are abutted against each other with longitudinal side 40A meeting with longitudinal side 40B of the adjacent panel, a slot 26 is created as described above which is filled after assembly of the wall system with a vertical filler piece 22 as described above. In all other respects, panel 10A is similar to panel 10.

The back sides 52 of the light gauge metal studs 32 have rectangular 58A or holes of other shapes. The polymer foam extends into the holes 58 and open slot 56 to fill the central cavity 57 of the studs.

Figure 11:
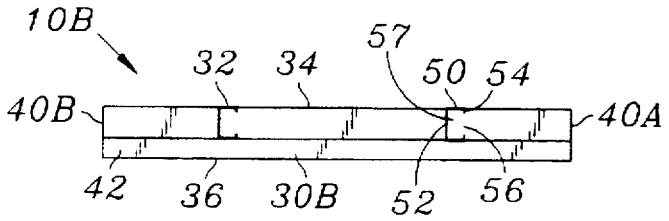
FIG. 11 is a top view of another embodiment of the composite wall panel of the present invention.
Figure 12A:
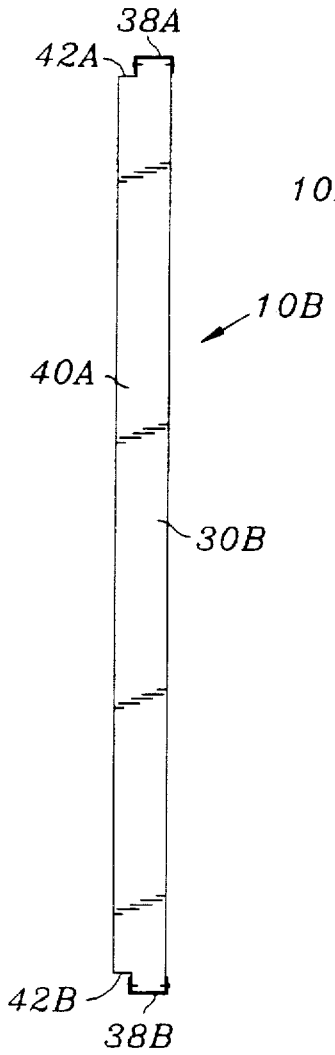
FIG. 12A is a plan view of a longitudinal side of the composite wall panel of FIG. 11.
Figure 13:
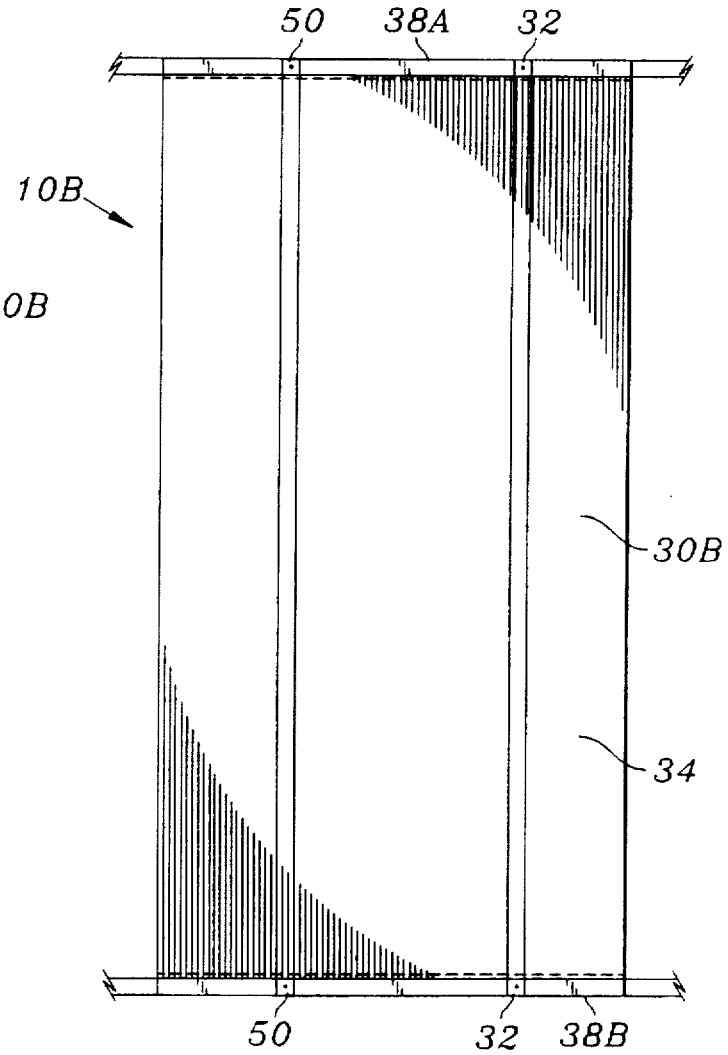
FIG. 13 is a plan view of a primary wall surface of the composite wall panel of FIG. 11.
Figure 12B:
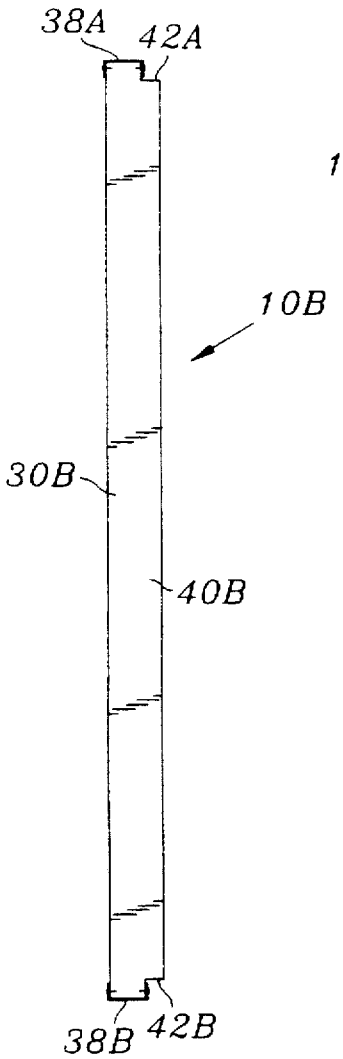
FIG. 12B is a plan view of the other longitudinal side of the composite wall panel of FIG. 11.
Figure 14:
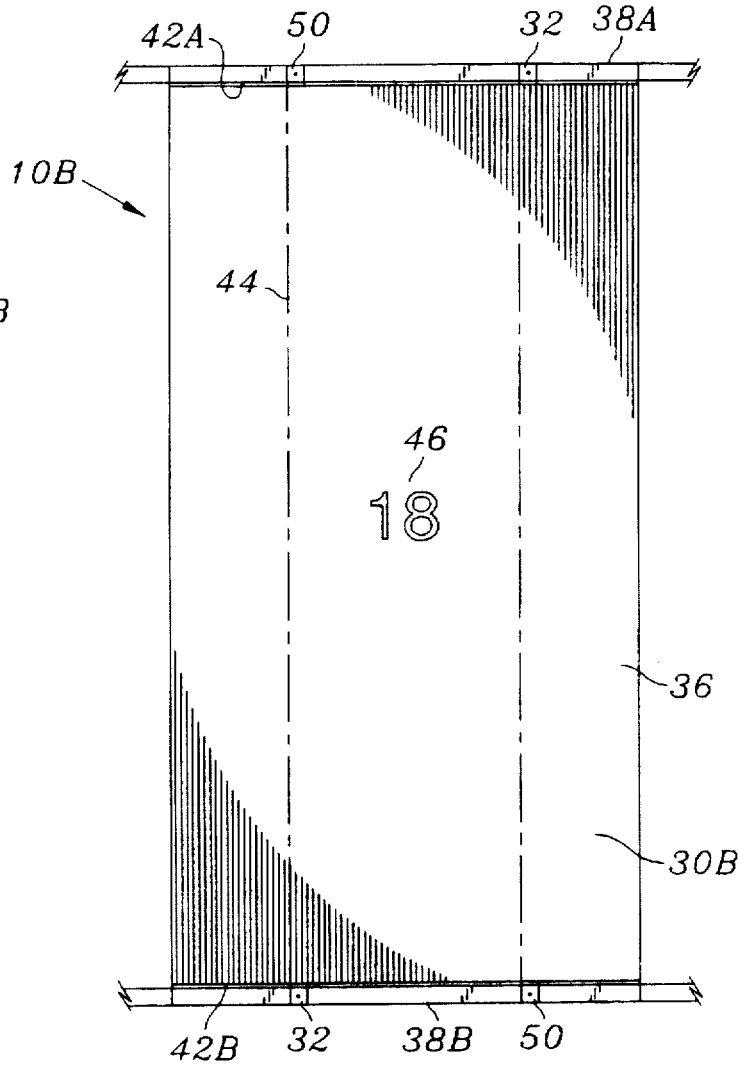
FIG. 14 is a plan view of the opposing primary wall surface of the composite wall panel of FIG. 11.
Figure 15:
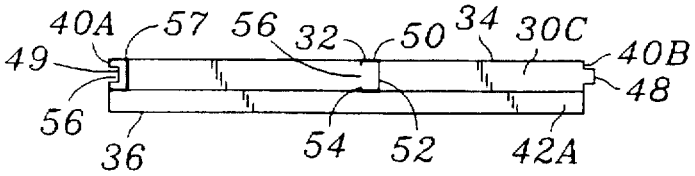
FIG. 15 is a top view of another embodiment of the composite wall panel of the present invention.
Figure 16A:
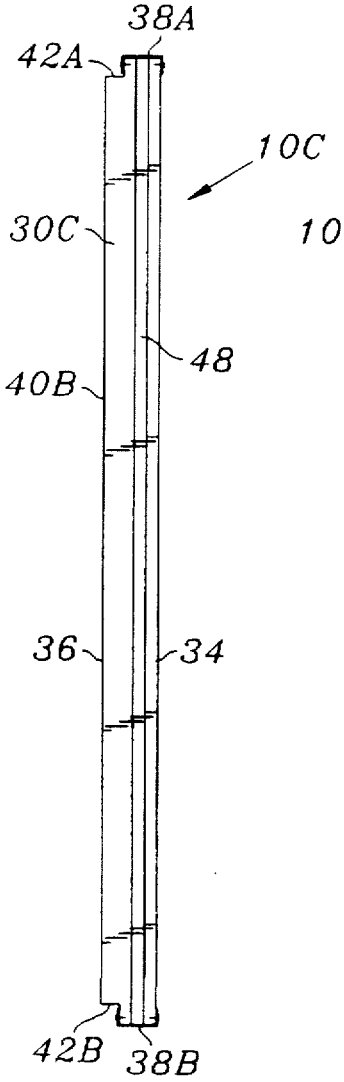
FIG. 16A is a plan view of a longitudinal side of the composite wall panel of FIG. 15.
Figure 17:
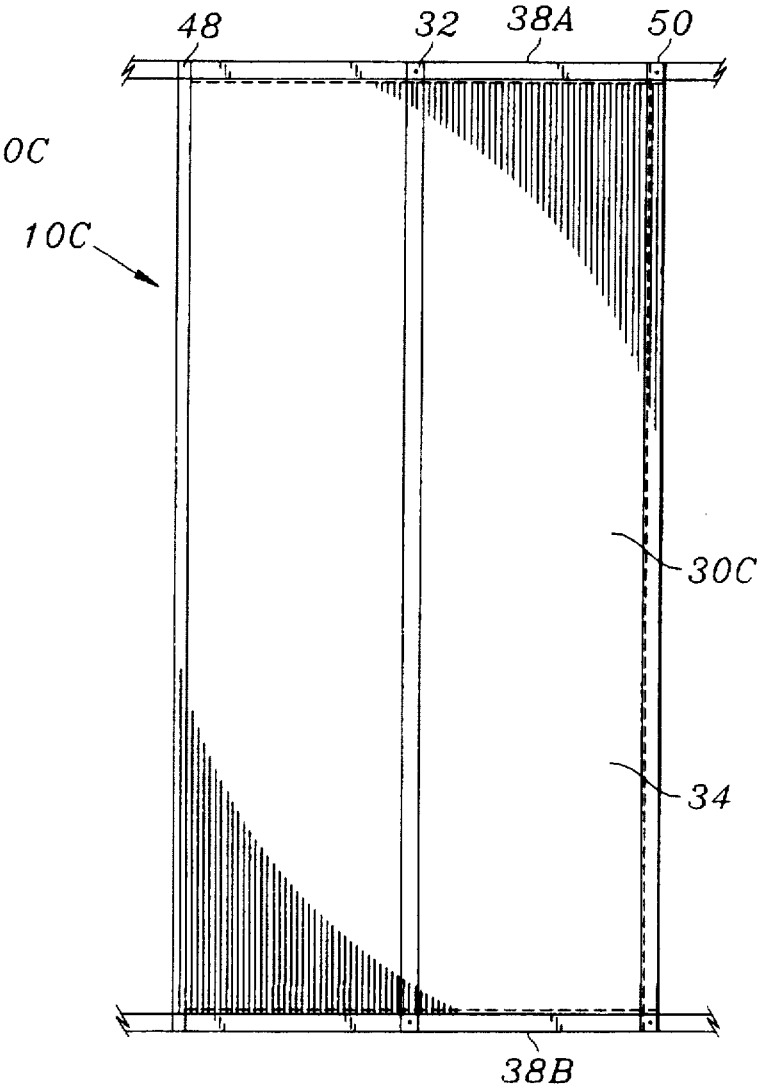
FIG. 17 is a plan view of a primary wall surface of the composite wall panel of FIG. 15.
Figure 16B:
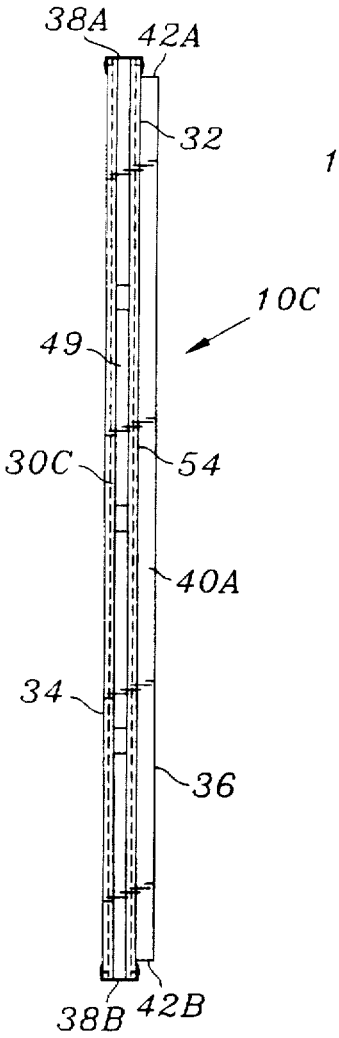
FIG. 16B is a plan view of the other longitudinal side of the composite wall panel of FIG. 15.
Figure 18:
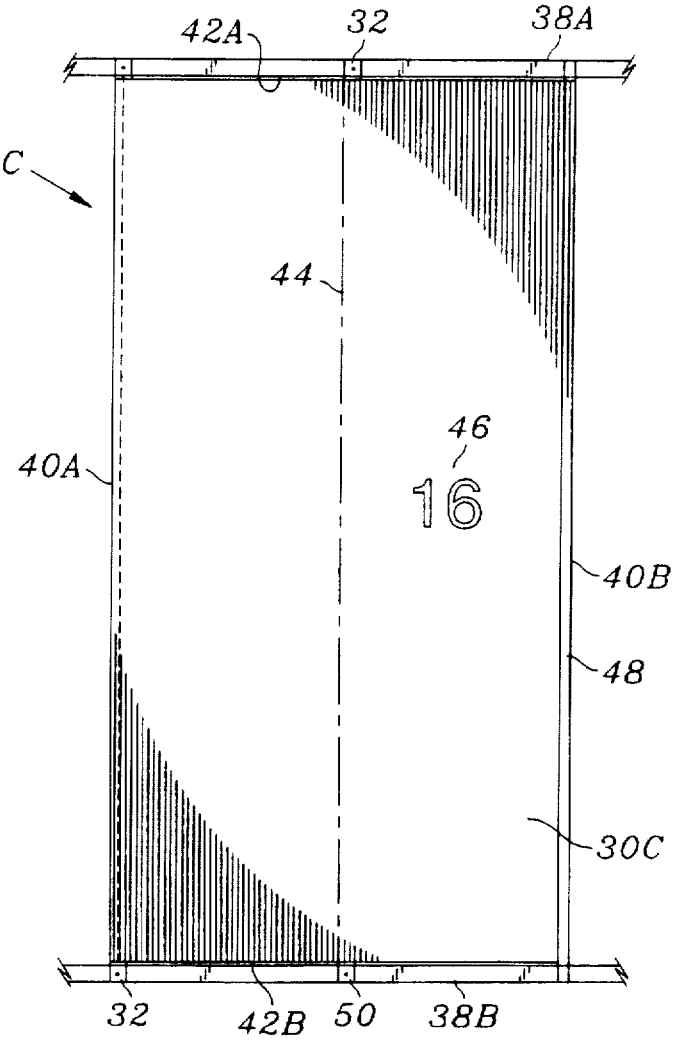
FIG. 18 is a plan view of the opposing primary wall surface of the composite wall panel of FIG. 15.
Figure 19:
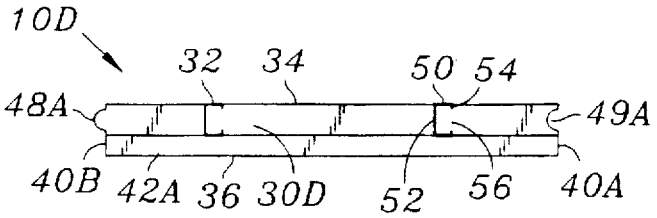
FIG. 19 is a top view of another embodiment of the composite wall panel of the present invention.
Figure 20A:
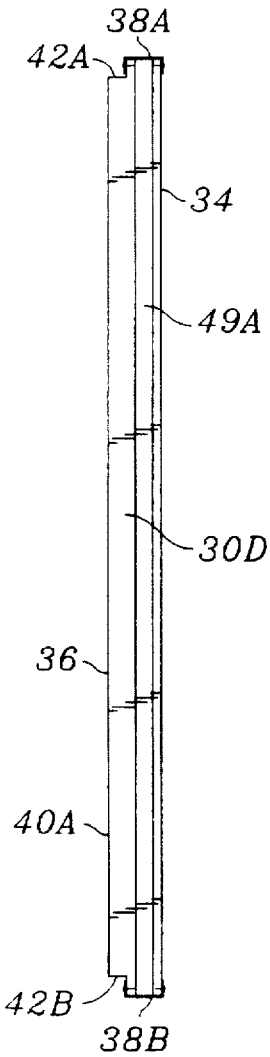
FIG. 20A is a plan view of a longitudinal side of the composite wall panel of FIG. 19.
Figure 21:
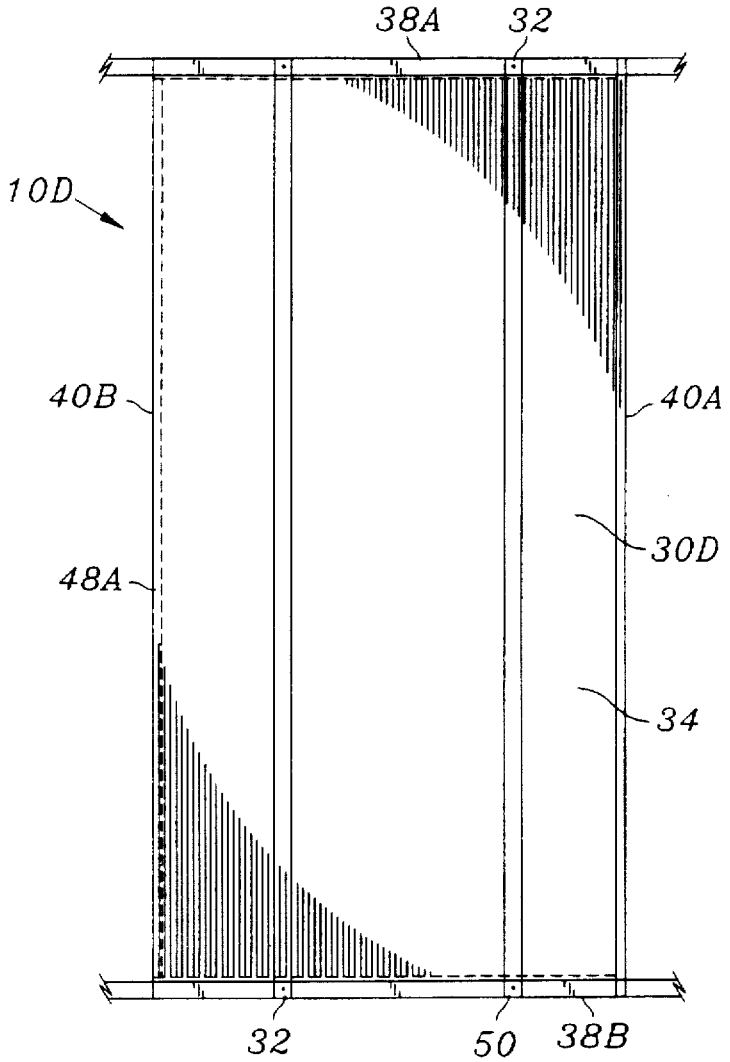
FIG. 21 is a plan view of a primary wall surface of the composite wall panel of FIG. 19.
Figure 20B:
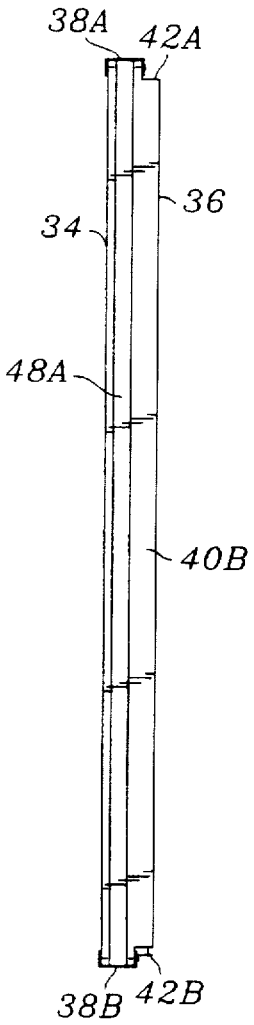
FIG. 20B is a plan view of the other longitudinal side of the composite wall panel of FIG. 19.
Figure 22:
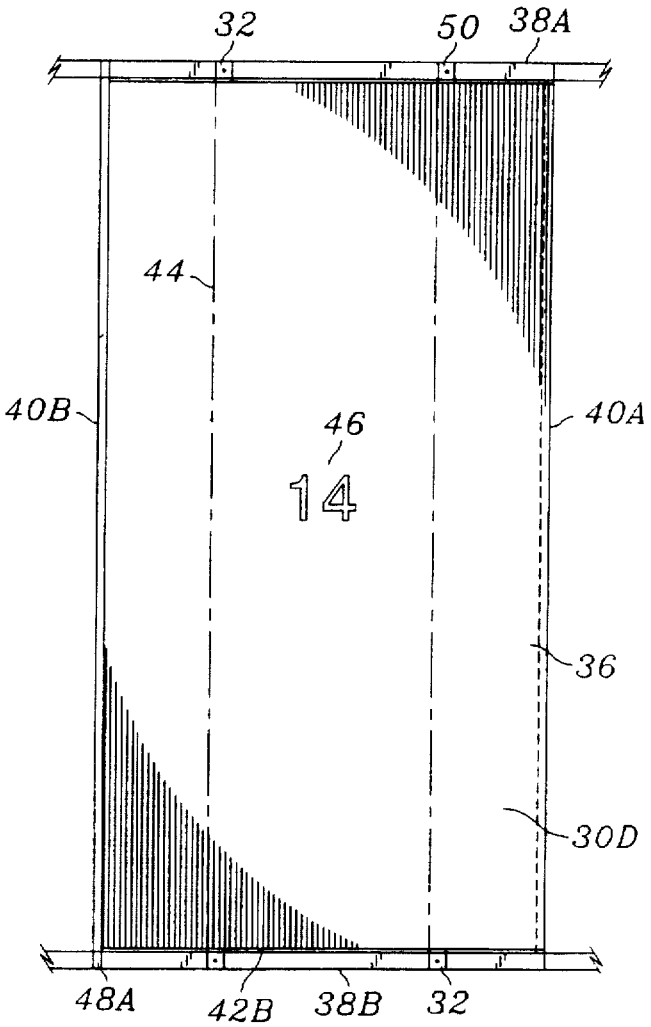
FIG. 22 is a plan view of the opposing primary wall surface of the composite wall panel of FIG. 19.
Figure 23:
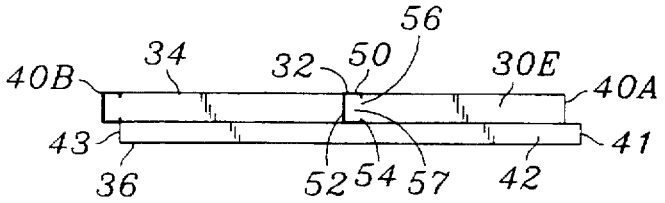
FIG. 23 is a top view of another embodiment of the composite wall panel of the present invention.
Figure 24B:
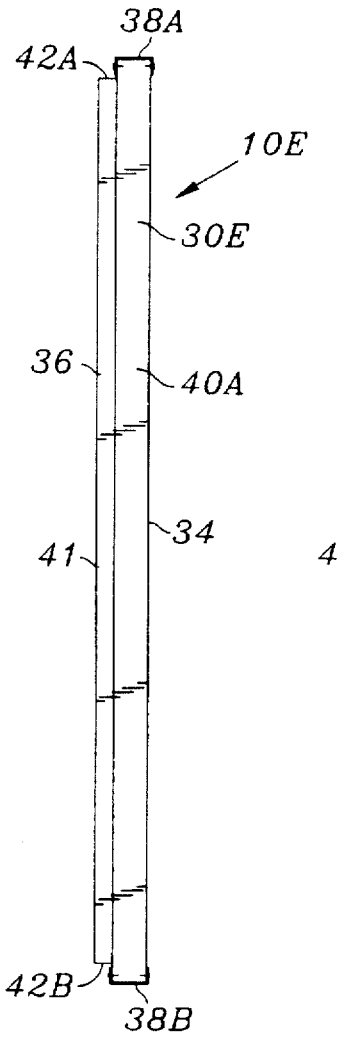
FIG. 24B is a plan view of the other longitudinal side of the composite wall panel of FIG. 23.
Figure 25:
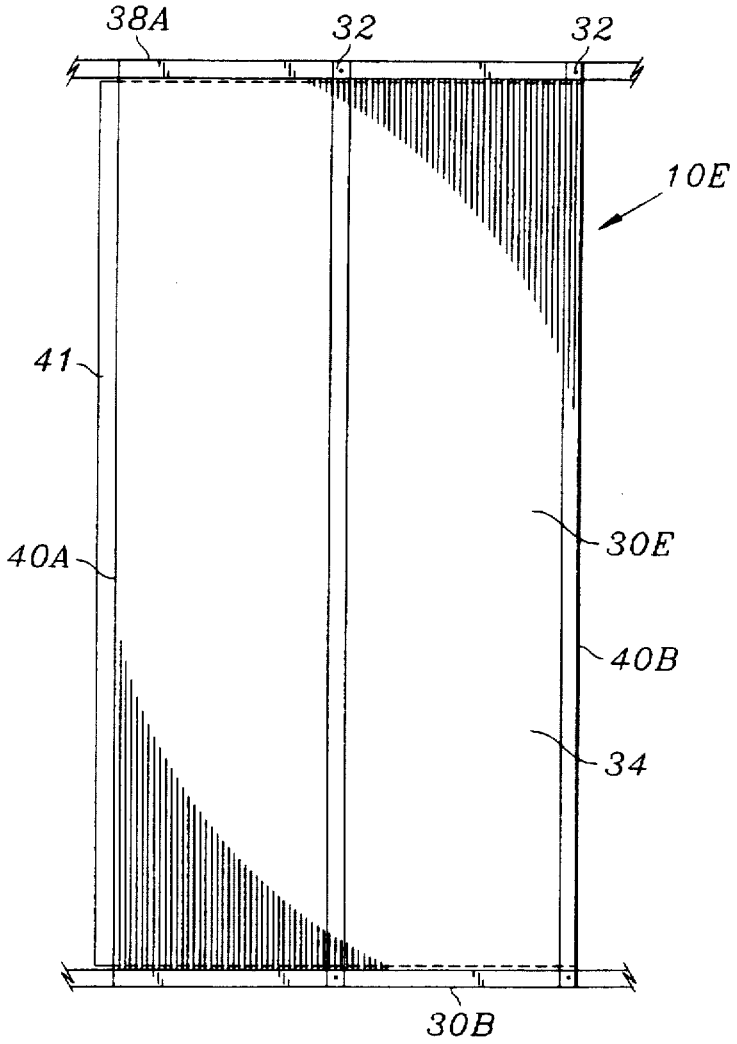
FIG. 25 is a plan view of a primary wall surface of the composite wall panel of FIG. 19.
Figure 24A:
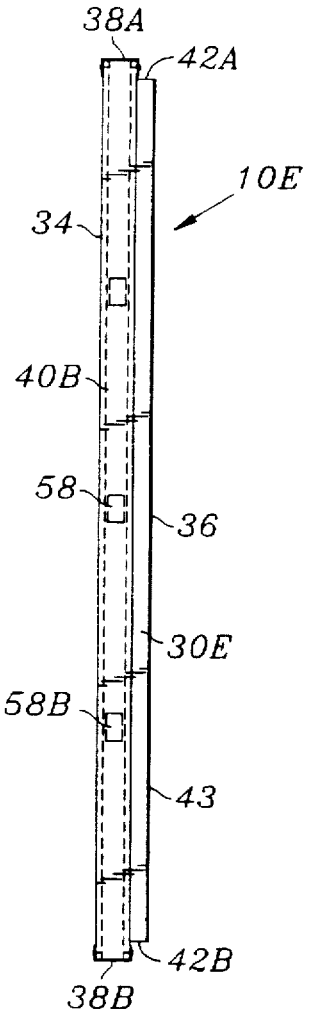
FIG. 24A is a plan view of a longitudinal side of the composite wall panel of FIG. 23.
Figure 26:
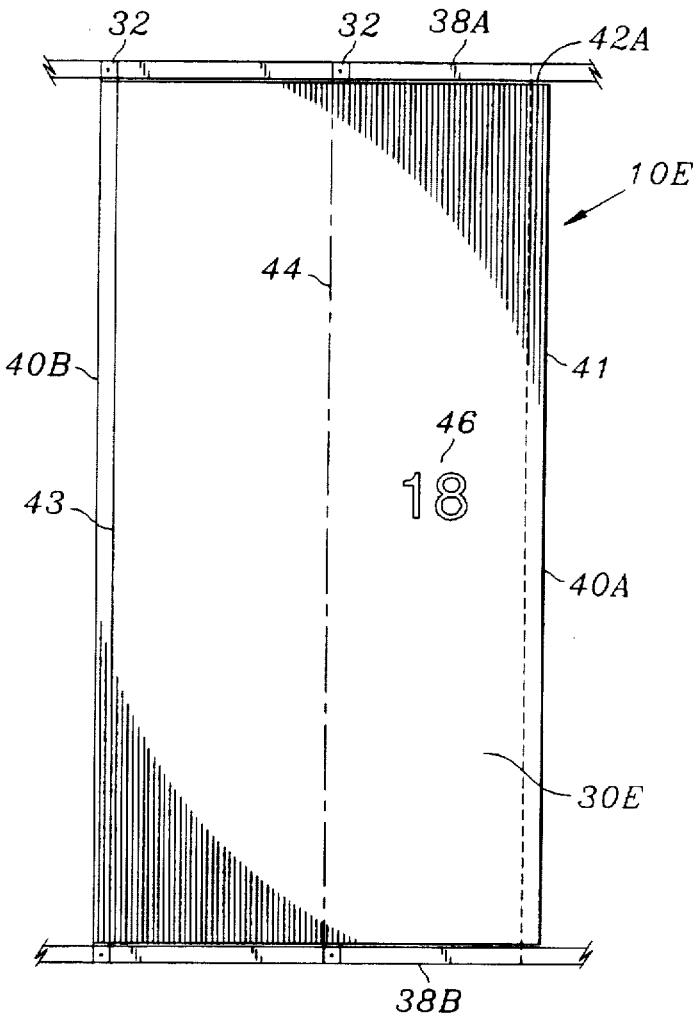
FIG. 26 is a plan view of the opposing primary wall surface of the composite wall panel of FIG. 23.

Referring to FIG. 11, the composite wall panel 10B has both light gauge metal studs 32 positioned between the longitudinal side walls 40A and 40B of the panel. A stud is not positioned on a side wall 40 as in panel 10. In all other respects, the composite wall panel 10B is similar to the composite wall panel 10A.

Referring to FIGS. 15–18, the composite wall panel 10C has a stud 32 positioned at one of the longitudinal side walls 40A of the panel with its open channel 56 facing outwardly. In contrast the composite wall panel of 10 has the open channel 56 of the light gauge metal stud 32 positioned on one longitudinal side 40A of the panel facing inwardly into the body 30. As in all the composite wall panels, the central cavity 57 of the studs is filled with polymer foam. The polymer foam extends from body 30C into the central cavity through the holes 58 in the back wall 52 of the stud to securely bind the body and studs. The central cavity may however, not be completely filled with polymer foam. However, the end stud 32 of panel 10C having its open channel exposed to the exterior, has a portion of the polymer foam of the central cavity cut away to form a groove 49. The other longitudinal side 40B of the panel 10C is formed with a tongue 48 which is adapted to engage the groove 49 of an adjacent panel 10C (not shown) when the panels are positioned and placed and abutted together to form a wall system. This tongue and groove construction increases the strength of the wall system since it helps bind the panels together and inhibits drafts and air leakage through the joint formed by side walls 40A and 40B between adjoining panels. In all other respects, panel 10C is similar to panel 10.

Referring to FIGS. 19–22, the composite wall panel 10D is similar to the composite wall panel 10B with the exception that the panel has a groove 49A molded into the body 30D on longitudinal side wall 40A and a tongue 48A molded into the body 30D on the other longitudinal side wall 40B. When adjacent panels 10D are abutted or joined together in tracks 12A and 12B, the groove 48A mates with the tongue 48A of the adjoining panel to form a strong interlocking wall system of the composite wall panels. The tongue and groove construction helps bind the individual panels together and inhibits drafts between the joints or seams of adjacent panels.

Referring to FIGS. 23–26, the composite wall panel 10E is similar to the composite wall panel 10 with the exception that the composite wall panel 10E is formed with a lip 41 on the primary wall surface 36 of the panel on longitudinal side wall 40A and with a shoulder 43 on the primary wall surface 36 at the other longitudinal side wall 40B of the panel. The lip 41 is designed to engage shoulder 43 of an adjacent panel to form an overlap joint when the panels are abutted and joined next to each other in light metal gauge tracks 12A and 12B. The overlap joint prevents drafts between the joint or seam of adjacent panels. Some studs 32 available on the market have round holds, rectangular holes 58 square holes or other shaped holes in their back walls 52. In all other respects, the composite wall panel 10E is similar to the composite wall panel 10.

Figure 27:
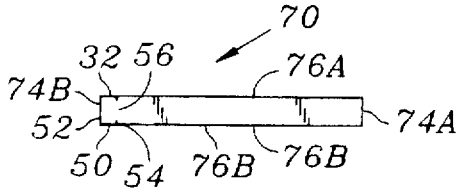
FIG. 27 is a top view of an interior composite wall panel of the present invention.

Referring to FIG. 27, a wall composite wall panel 70 is shown which is normally half the transverse width of the composite wall panels 10A through 10E. It is envisaged that panel 70 will be used primarily in interior wall systems. However, it can be used in the exterior wall systems. Preferably the composite wall panels 10–10E are used for exterior walls. Conveniently, the transverse width of panel 70 between the longitudinal side walls 74A and 74B is a standard building construction distance between the studs, center to center, required for the wall structure. Typically, this is 24" or 16". Interior composite wall panel 70 comprises a body 72 of polymer foam and a light gauge metal stud 32 secured at one end of the body. The polymer foam extends into the central cavity 57 of the stud. The width of the panel between the primary wall surfaces 76A and 76B is the width of the stud 32. The interior composite wall panel 70 is thinner than composite wall 10–10E panels because the insulation demands of interior walls is much less than exterior walls. The panels 70 are utilized and assembled in the same manner as panels 10–10E.

Figure 28A:
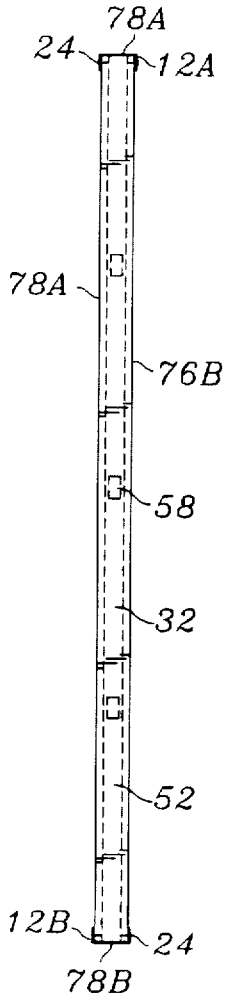
FIG. 28A is a plan view of a longitudinal side of the composite wall panel of FIG. 27.
Figure 29:
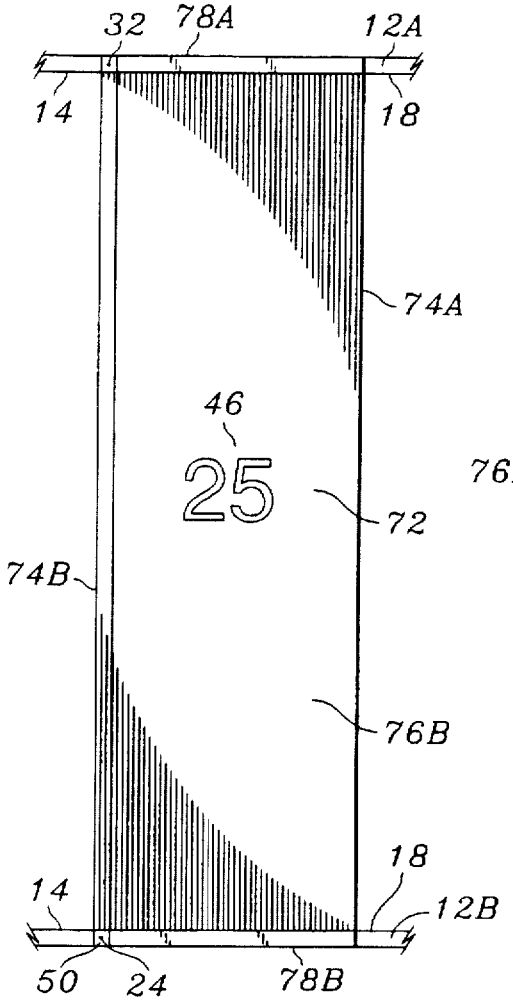
FIG. 29 is a plan view of one of the primary wall surfaces of the composite wall panel of FIG. 27.
Figure 28B:
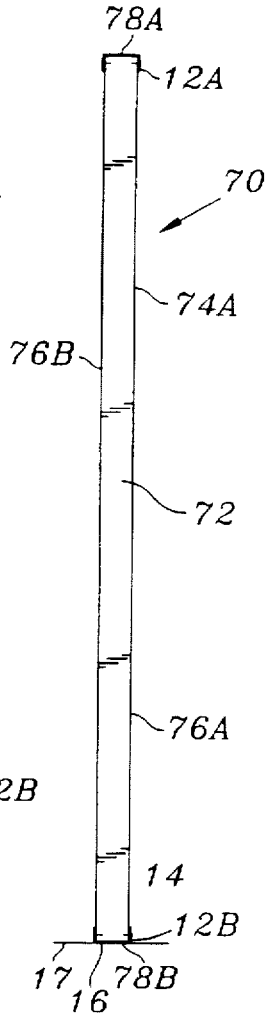
FIG. 28B is a plan view of the other longitudinal side of the composite wall panel of FIG. 27.

Referring to FIGS. 28A, 28B and 29, a bottom track 12B is attached to a flooring system 17. The bottom sides of 78B of one or more panels 70 are inserted into the open channels 18. The lower track 12B and upper track 12A are shown in phantom in FIG. 29. A plurality of panels are inserted into the track and abutted up against each other to form a continuous, smooth interior wall (not shown). In this manner, studs 32 of each panel will be "on center" as required by the building codes. After the panels are assembled in the bottom track, the top track 12A is lowered onto the upper side 78A of the panels 70 with the open channel extending over and onto the upper side 78A. Side walls 14 of the upper track and lower track keep the walls aligned to form a smooth continuous wall surface on each side of the panels. The panels are screwed into the tracks by screwing in self tapping meal screws 24 through the side wall 14 of the tracks into the side walls 50 of the studs 32 of the panel. The panel surfaces 76A and 76B can be plastered, covered with sheet rock, tiled or the like. The sheet rock or other paneling can be adhesively attached to the panels or screwed into the studs of the panels.

Doors and other elements in walls can be made with light metal gauge studs and light metal gauge track in the conventional manner. Utilities are brought down from above or up from below through holes in the tracks and runs or channels in the polymer foam of the body cut with heat knives. Alternatively, the utilities can be run horizontally through the panels.

Figure 30:
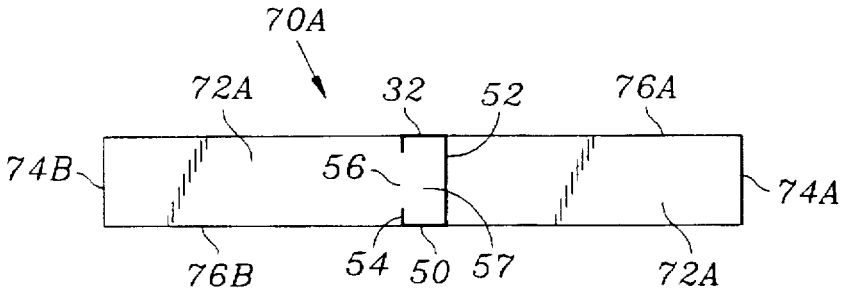
FIG. 30 is a top view of another embodiment of the composite wall panel of the present invention.
Figure 30A:
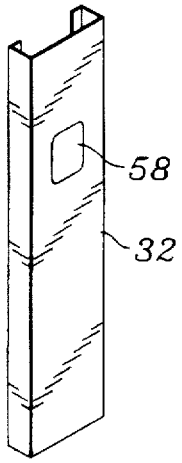
FIG. 30A is a partial perspective view of the back side of the light metal gauge stud of the panel of FIG. 30.

Referring to FIG. 30, an alternative embodiment of the interior composite wall panel 70A has the light metal gauge stud 32 positioned in the body 72A of the panel between the longitudinal walls 74A and 74B. The body 72A of the panel extends on both sides of the stud and the polymer foam of the body extends into the central cavity 57 of the stud. The back wall of stud 52 has a plurality of apertures 58 (see FIG. 30A) which can be circular, rectangular, square, diamond shaped, oval shaped. The polymer foam extends into the central cavity through the open slot 56 and through the holes 58 to securely bind the stud with the polymer foam body.

Figure 31:
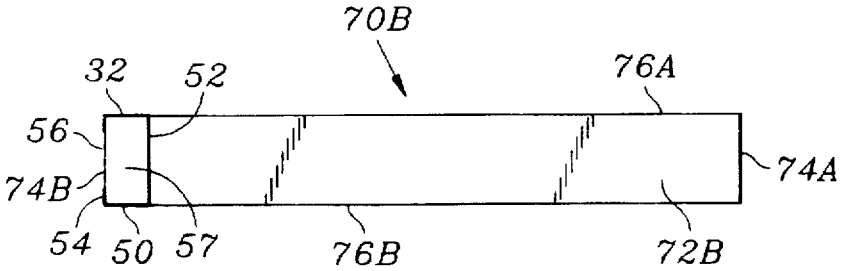
FIG. 31 is a top view of another embodiment of the composite Wall panel of the present invention.

Referring to FIG. 31, another embodiment of the interior composite wall panel 70B comprises a body 72B and a stud 32. The body 72B is composed of polymer foam as the other composite wall panels of the present invention and the polymer foam extends through the apertures 58 (not shown) in the back wall 52 of the stud 32 into the central cavity 57 of the stud. The polymer foam extending through the aperture 58 between the central cavity and the body 72 binds the stud 32 securely with the body.

Figure 32:
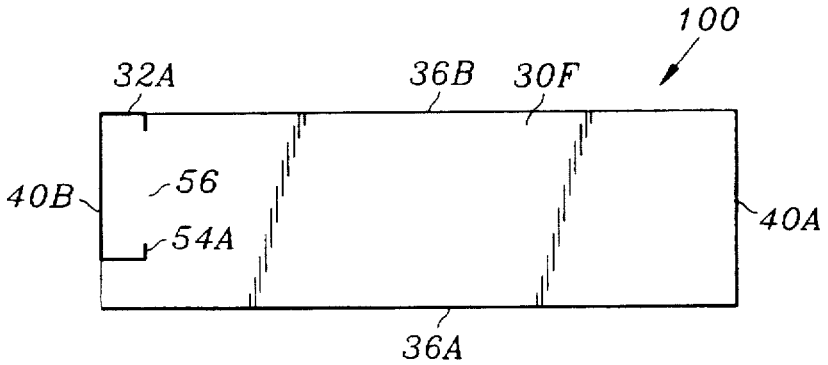
FIG. 32 is a top view of another embodiment of the composite wall panel of the present invention.

Referring to FIG. 32 a composite wall panel 100 having a large, i.e., wide stud 32A and a thick body 30F is shown. Such large dimensional panels can be easily made and used. Such panels would find use for heavy construction were the ceiling, upper floor or roof loading would be substantially greater than found in typical 1–3 story framed buildings. The polymer foam fills the body 30F and extends into the central cavity 57A of the stud through open slot 56A.

The composite wall panels of the present invention offer many advantages over the existing metal/polymer composite wall panels. The composite wall panels are made from commercially available materials including the light metal gauge studs 32 and the polymer foam. Many types of polymer foams can be utilized including extruded polymer foams such as polystyrene, polyethylene, polyisocynaurite and polyurethane and expanded polymer foams such as polystyrene and polyurethane. The panels are dimensionally stable and have flat continuous surfaces to provide a continuous smooth wall system having flat planar surfaces which can be easily covered with lathe and plaster, gypsum board, composite panels, tile and the like. The panels are lightweight and can be easily carried by a single man or woman even when they contain up to four studs and have dimensions as great as 4×12'. The composite wall panels will not support combustion. The polymer foam incorporates a fire resistant material known to the art such as halogenated phosphates, antimony oxide, and the like. The polymer foam is preferably a closed cell foam which prevents water saturation and offers a greater degree of thermal and sound insulation. The panels are completely impervious to dry rot and completely resistant to termite damage. The passive interaction of the studs with the polymer foam body, and the passive interaction of the assembled panels in a wall system secured with the top track and bottom track, provide an extremely strong and rigid wall which offers tremendous lateral stiffening and far greater vertical load bearing capacity than comparable wood framing walls.

An additional advantage of the composite wall panels arises because they do not have to undergo extensive testing to obtain building and structural approvals from governmental agencies, ICBO, BOCCA, and the like, because light gauge steel construction is already accepted and widely used in the building industry.

The panels can be used to build a structure employing standard wood framing techniques. The wall/frame assembly using the panels can be carried out on the ground or on the floor and then the wall/frame assembly is raised as a complete wall system with detailing completed when the wall is up, such as plumb and line of the walls and completing the fastening of the tracks and studs.

The panels are squared and have straight flat walls. Thus the panels and tracks are assembled with a minimum of plumbing compared to straight wood or light metal framing. Yet the assembled wall system retains sufficient give to permit slight racking of the assembly to make the assembled wall system plumb when the floor system is not exactly level.

In conventional light metal framing, the studs side walls 50 must be clamped to the track side walls prior to fastening because when the fasteners are screwed through the side wall 14 of the track 12 into the side wall 50 of the stud 32, the side wall of the stud can bend inwardly toward the open slot 56 of the stud causing a gap to form between the side wall of the track and the side wall of the stud. This gap weakens the joinder of the stud and track, and, thus, the stud side wall is clamped to the side wall of the track to prevent such gaps. This gap problem is advoided with use of the present panels because the polymer foam, which at least partially fills the central cavity 57 of the stud, prevents a side wall of the stud from flexing inwardly toward the open slot 56. Thus the tracks and panel studs can be fastened without the need for clamping.

The panels are manufactured in molds to form a continuous body of polymer foam. Studs can easily be positioned in the mold with one side wall 50 of the studs 32 positioned at the bottom of the mold in register with the interior surface of the wall panel. The polymer foam is injected, molded or extruded into the mold to form the composite wall panels described herein.

Conventional light metal gauge studs, also known as light gauge steel studs, light weight, cold-formed steel members, cold-formed steel structural members, metal studs or steel studs, c-stud, joist, can be employed in the present invention including SHD, X SHD and XX SHD studs having various leg sizes such as 1⅜ inch, 1½ inch, 2 inch and various web sizes, such as 3½ inch up to 8 inch. The web size is the width of the stud and the leg size is the thickness of the stud. The width of the back wall is equivalent to the web of the stud and the length of the side wall is the length of the leg of a stud. The light metal gauge studs employed in this invention preferably are engineered to meet the specifications of the 1986 Edition of the AISI (American Iron and Steel Institute) publication "Specification for the Design of Cold-Formed Steel Structural Members", including 1989 amendments and comply with the Uniform Building Code.

We claim:

1. A structural, insulating, insect-resistant, dimensionally stable composite wall panel for building construction comprising:

a rectangular, tetragonal body of polymer foam having two opposing primary wall surfaces bounded on its side by two parallel side walls and on its end by two parallel end walls;

at least two light metal gauge studs in the body, each stud having a hollow central cavity, a squared cross-section with a wide back wall extending the width of the studs, two parallel side walls, two narrow front walls parallel to the back wall separated by an open slot extending into the central cavity of the stud, each light metal gauge stud extending at least from one end wall to the other end wall and parallel to the side walls of said body, the width of the wall panel between the two primary wall surfaces being greater than the width of the studs, the polymer foam extending into the central cavity of the stud to secure the stud to the body, at least one side wall of each stud forming a portion of the same primary wall surface of the body, one stud positioned at one of the parallel side walls with its open slot extending outwardly from the side wall, the distance between each of the studs, from the center to center of the studs being a standard building construction center-to-center distance for studs, the rectangular tetragonal body of polymer foam having a tongue portion at each of its two parallel end walls, the tongue portion having a width equal to the width of the studs and adapted to be and received by and secured in the open channel of light metal gauge building construction track to form a structural wall.

* * * * *